United States Patent [19]

Bartlett

[11] 4,439,969

[45] Apr. 3, 1984

[54] DEVICE FOR AFFIXING PANELS IN ABUTTING RELATIONSHIP TO A SUPPORT STRUCTURE

[76] Inventor: Gary F. Bartlett, G. F. Bartlett & Associates, Rose Hill Rd., R.D. #3, Muncy, Pa. 17756

[21] Appl. No.: 315,910

[22] Filed: Oct. 28, 1981

[51] Int. Cl.[3] ..... E04C 1/34

[52] U.S. Cl. ..... 52/461; 52/466; 52/469

[58] Field of Search ..... 52/465–467, 52/460, 461, 469; 49/17

[56] References Cited

U.S. PATENT DOCUMENTS

| | | | |
|---|---|---|---|
| 380,864 | 4/1888 | Cooper | 52/465 |
| 1,931,750 | 10/1933 | Blaski | 52/460 |
| 2,078,970 | 5/1937 | Patterson | 52/465 |
| 2,784,814 | 3/1957 | Bright | 52/461 |
| 4,068,423 | 1/1978 | Marsh | 47/17 |

FOREIGN PATENT DOCUMENTS

| | | | |
|---|---|---|---|
| 1031250 | 6/1953 | France | 52/465 |
| 1124040 | 10/1956 | France | 52/465 |
| 1525985 | 4/1968 | France | 52/465 |
| 539444 | 2/1956 | Italy | 52/465 |
| 225944 | 6/1943 | Switzerland | 52/461 |
| 2531 | of 1898 | United Kingdom | 52/461 |

*Primary Examiner*—Henry E. Raduazo

*Attorney, Agent, or Firm*—Finnegan, Henderson, Farabow, Garrett & Dunner

[57] ABSTRACT

A device for affixing two panels in abutting relationship to a support structure including an elongated base member with two transversely spaced, elongated areas each defining a planar surface for engaging the underside of the panels, an elongated locking projection integral with and extending from the base member with a height greater than the thickness of the panels, and areas for receiving fasteners to secure the base member to the support structure. The device also includes an elongated cap with an integral, elongated slot for engaging the locking projection and elongated panel contacting areas on each side of the slot for contacting the upper surface of the panels.

4 Claims, 7 Drawing Figures

Fig. 1
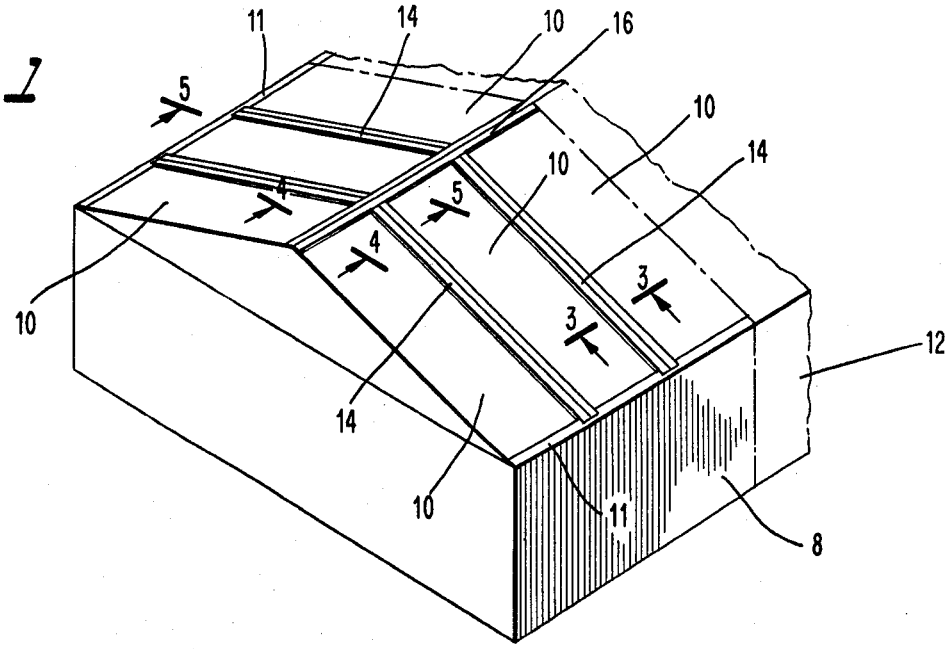
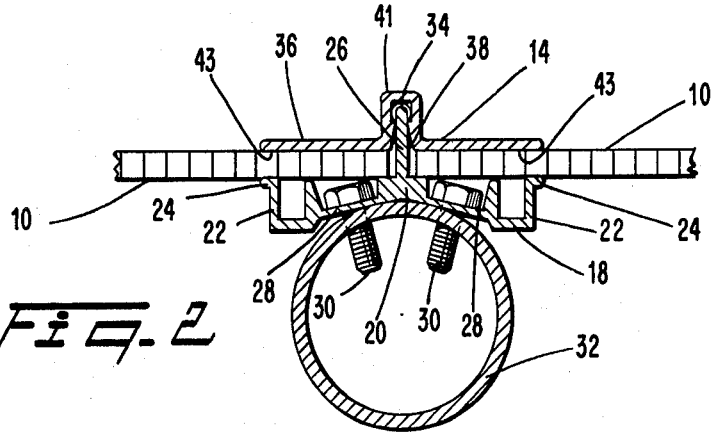
Fig. 2
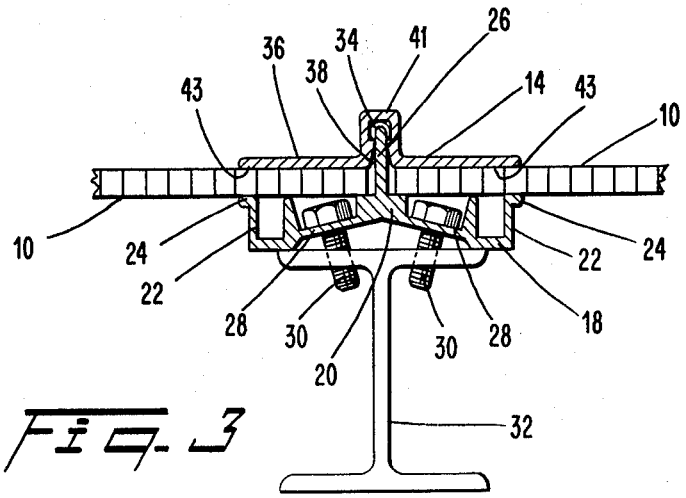
Fig. 3

DEVICE FOR AFFIXING PANELS IN ABUTTING RELATIONSHIP TO A SUPPORT STRUCTURE

BACKGROUND OF THE INVENTION

1. Field of the Invention

This invention relates to a device for affixing panels in abutting relationship to a support structure. In particular, the invention is a device for securing panels of a building roof to the roof support structure or for securing solar collection panels to a support structure.

2. Summary of the Prior Art

Known methods of securing multiple panels forming a building roof to the roof support structure involve a variety of attachment techniques and various means for sealing seams between panels. Generally these methods are designed to be permanent and require significant labor and supply for installation and repair if necessary.

In greenhouses and solar collection devices, certain specific requirements must be met for roof structures. Principally, the roof must be transparent or translucent to allow light into the greenhouse or into contact with the heat or electricity-generating element. Materials providing for light passage are generally more easily damaged than normal roof material and are not readily secured to the roof support structure by the usual method such as fasteners passing through the material. Furthermore, many such light-transmitting materials, such as plastic, are subject to significant thermally-induced expansion and contraction. Thus, greenhouse and solar collection structures must provide a means for securing panels to a support structure without direct fastening, which seals the seams between abutting panels while permitting relatively easy removal and replacement of damaged panels and which permits expansion and contraction without damage to panels or degradation of seals between panels. Naturally, the system used should be reusable so that replacement of damaged panels does not require the additional expense of replacing the devices used to secure the panel.

In view of the necessity to protect the interior of the solar collection device or greenhouse from the elements, the securing system should seal seams between panels, facilitate run-off of rain, and minimize the number of seams which must be sealed.

The instant invention provides a device for securing room or solar collection panels to a support structure which permits use of larger panels thereby reducing the number of seams, seals the seams between panels, permits thermally induced expansion and contraction of panels, provides a channel for run-off of rain or snow which leaks through the seams, consists of a minimum number of parts, and is easy to install, remove and reinstall, thus providing simple and inexpensive installation and repair.

The device of the invention is also versatile, permitting installation on existing structures when replacing old or inadequate roof or solar panels.

The invention is made of extruded metal of sufficient flexibility to permit installation of single, elongated securing and sealing devices across the width of an arch-type roof. Thus, large panels may be used which extend in one piece across the arch roof between opposite walls. Use of such large panels eliminates many seams between panels and reduces the cost of material and labor in installing the device for securing the panels to the support structure.

Since the invention secures panels to the support structure with two interlocking pieces, construction is simplified. Furthermore, the two interlocking pieces may be easily separated to permit removal and replacement of damaged panels.

SUMMARY OF THE INVENTION

The advantages of the invention will be set forth in part in the description which follows and in part will be obvious from the description, or may be learned by practice of the invention. The advantages of the invention may be realized and attained by means of the instrumentalities and combinations particularly pointed out in the appended claims.

In accordance with the invention, as embodied and broadly described herein, the device for affixing panels in abutting relationship to a support structure comprises an enlongated, extruded metal base member having an axial length and transverse width, the base member including means for engaging the underside of each panel, the engaging means contacting each panel at at least two transversely spaced, axially elongated contacting areas, the contacting areas being arranged in two groups, each group of contacting areas defining a generally planar surface. The base member further includes an integral, axially elongated locking projection having a height in excess of the thickness of the panels. The base member further includes means for affixing the base member to the support structure comprising means for receiving head fasteners between the contacting area. A plurality of U-shaped metal clip fasteners are engaged on the edge of the locking projection. An elongated, extruded metal cap member having an axial length and transverse width is provided for cooperation with the base member, the cap member including an integral, axially elongated slot for engaging the clip fasteners on the locking projection. The cap member further includes axially elongated panel contacting areas on each side of the slot disposed to contact the upper surface of the panels.

Preferably, in one embodiment, the base member has upper and lower surfaces, the upper surface being defined by elongated planar contacting areas adjacent to and on each side of the projection, fastener receiving areas adjacent to the contacting areas, and outer contacting areas adjacent the fastener receiving areas, the lower surface being defined by two opposite outer support contacting areas which are parallel to the planar contacting areas on the upper surface and the lower surface including a concave central portion.

In another embodiment, it is preferred that the panel contacting areas on the cap member be co-planar and the cap member include a cap projection above the panel contacting areas, the cap projection including the slot.

Preferably, the slot includes an inwardly tapered entry portion and a larger clip receiving portion at its inner extremity.

The accompanying drawings, which are incorporated in the and constitute a part of this specification, illustrate two embodiments of the invention and, together with the description, serve to explain the principles of the invention.

BRIEF DESCRIPTION OF THE DRAWINGS

FIG. 1 is a perspective view of a building structure having a pitch-type roof the roof panels of which are affixed in abutting relationship by the invention.

FIG. 2 is a cross-sectional view on line 2—2 of the embodiment of the invention depicted in FIG. 7.

FIG. 3 is a cross-sectional view on line 3—3 of the embodiment of the invention depicted in FIG. 1.

DETAILED DESCRIPTION OF THE PREFERRED EMBODIMENTS

Reference will now be made to the present preferred embodiments of the invention, examples of which are illustrated in the accompanying drawings.

Figure 7:
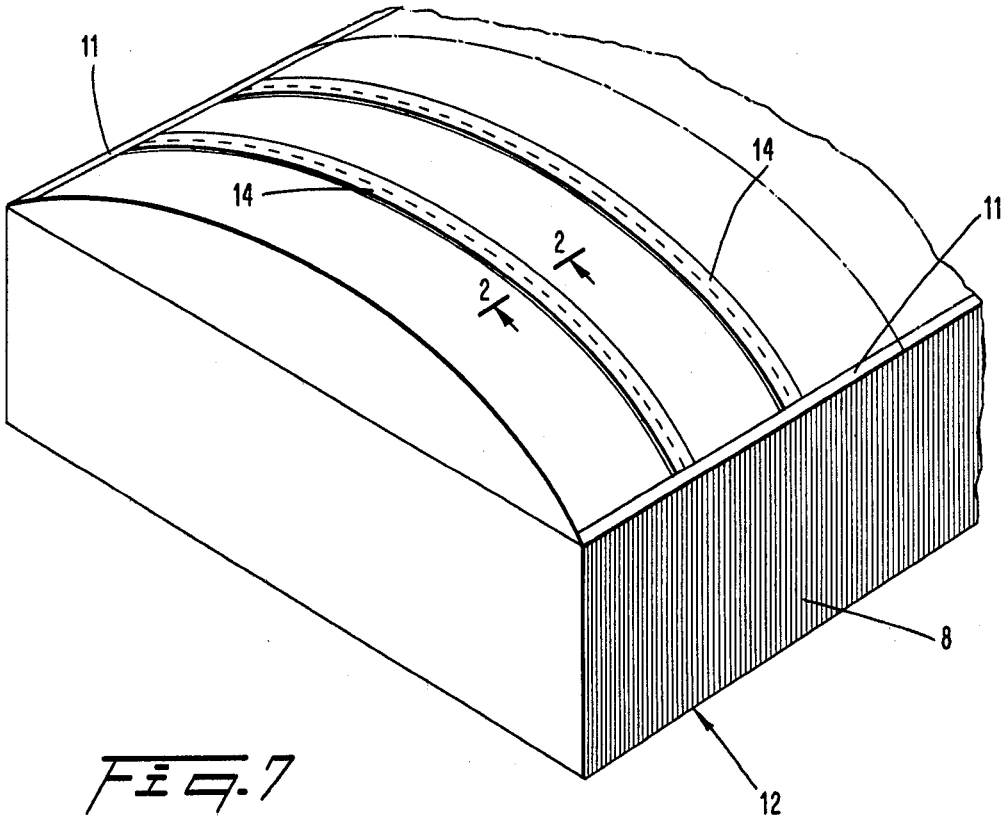
FIG. 7 is a perspective view of a building structure having an arch-type roof the roof panels of which are affixed in abutting relationship by the invention.

Referring to FIGS. 1 and 7, it may be seen that the roof panels 10 of the building structure 12 are secured in abutting relationship by devices 14 and 16 of the invention.

In accordance with the invention, the device for affixing two panels in abutting relationship to a support structure comprises an elongated, extruded metal base member having an axial length and a transverse width, the base member including means for engaging the underside of each of the panels at least at two transversely spaced, axially elongated contacting areas which are arranged in two groups, each group defining a generally planar surface.

Figure 6:
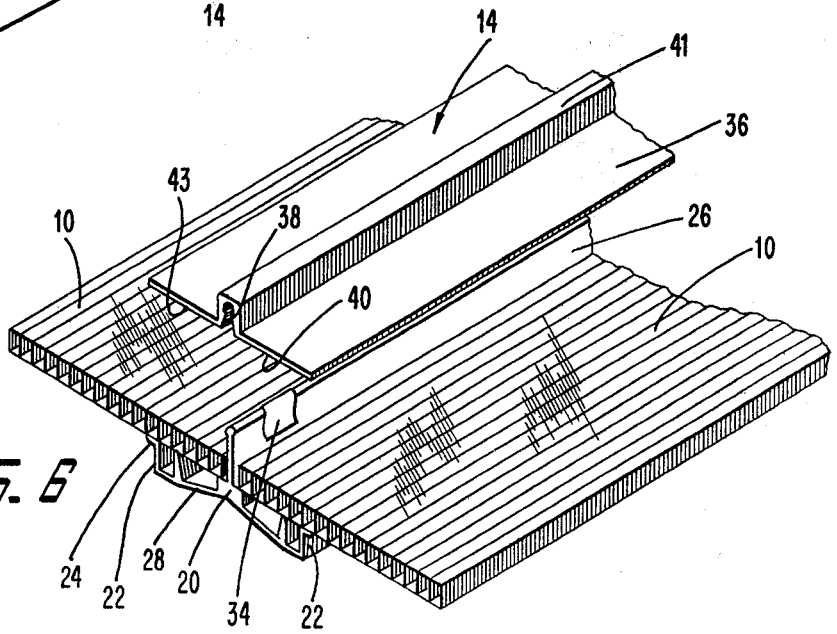
FIG. 6 is an exploded perspective view the embodiment of the invention in FIGS. 2 and 3.

As here embodied and depicted in FIGS. 2, 3 and 6, devices 14 for affixing panels 10 in abutting relationship comprise an elongated, extruded metal base member 18 including an axially elongated central support step 20 and a pair of axially elongated flanges 22, one flange 22 being disposed on each side of central support step 20. Each flange 22 has an outwardly extending elongated rib 24 at the edge of the flange 22 remote from base 18. Ribs 24 and central support step 20 constitute means for engaging the underside of panels 10 at least at two transversely spaced axially elongated areas. One side of support step 20 and a respective rib 24 constitute a group of contacting areas defining a generally planar surface.

Figure 4:
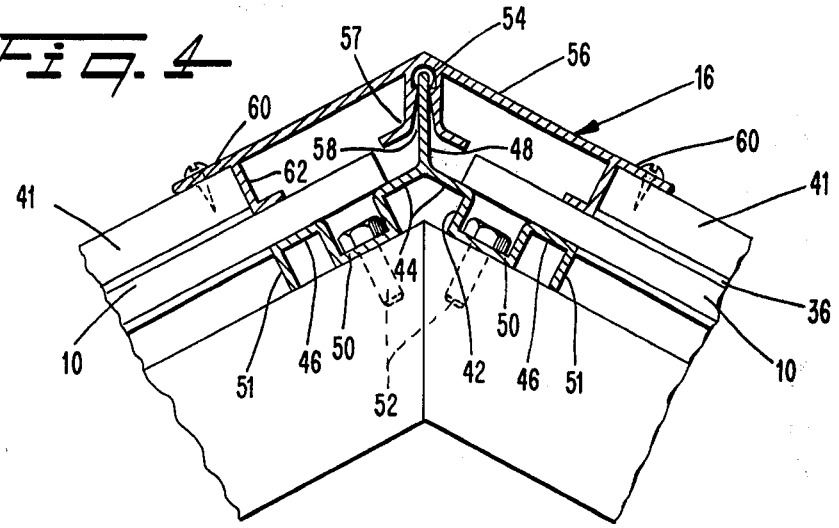
FIG. 4 is a cross-sectional view on line 4—4 of the embodiment of the invention depicted in FIG. 1.
Figure 5:
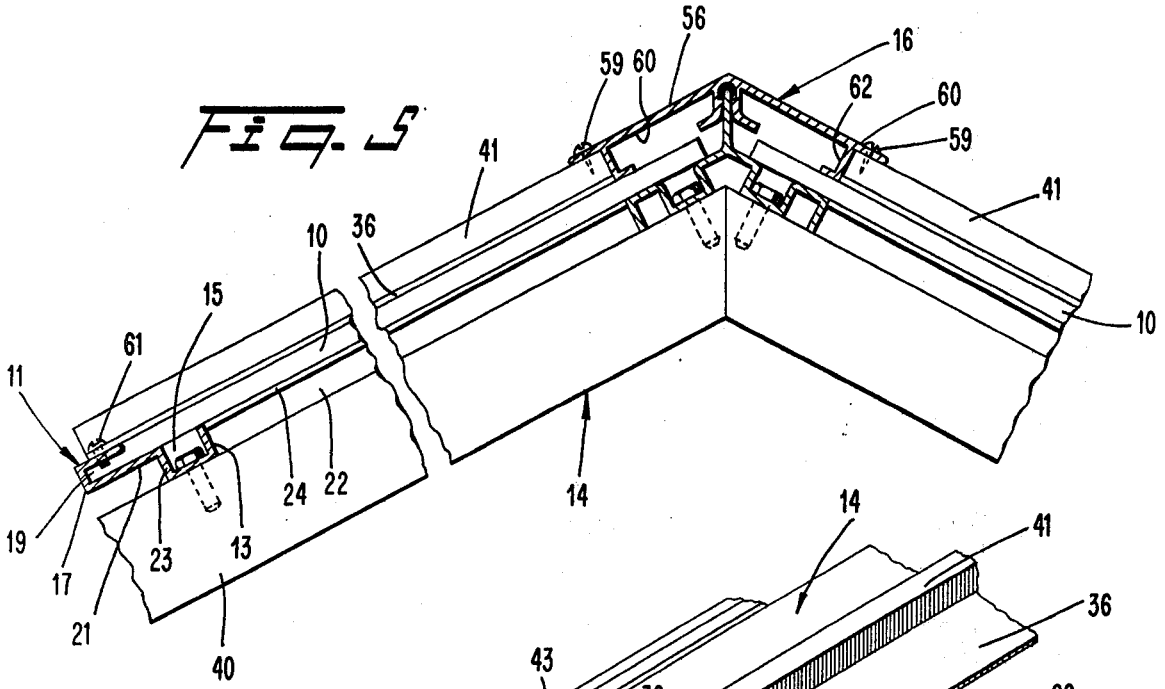
FIG. 5 is a cross-sectional view on line 5—5 of the embodiment of the invention of FIG. 1.

In the embodiment depicted in FIGS. 4 and 5, device 16 for affixing panels 10 in abutting relationship to support structure 40 comprises elongated extruded metal base member 42 having an axial length and a transverse width, the base member including central support step 44 and platforms 46 for engaging the underside of each of panels 10. One platform 46 is disposed on each side of, and transversely spaced from, central support step 44. One platform 46 and one side of central support step 44 constitute a group of contacting areas, each of the two groups of contacting areas defining a generally planar surface.

In accordance with the invention, the base member further includes an integral, axially elongated locking projection having a height in excess of the thickness of the panels. As embodied and depicted in FIGS. 2 and 3, base member 18 includes locking projection 26 integral and extending from central support step 20. Locking projection 26 has a height greater than panels 10. Similarly, in the embodiment depicted in FIG. 4, base member 42 includes integral, axially elongated locking projection 48 extending from the center of central support step 44 and having a height greater than the thickness of panels 10.

In accordance with the invention, the base member further includes means for affixing the base member to the support structure, the affixing means comprising means for receiving headed fasteners between the contacting areas.

As embodied and depicted in FIGS. 2 and 3, base member 18 includes axially elongated section 28 interconnecting flanges 22 with central support step 20 and having openings for receiving bolts 30 for affixing base member 18 to support structure 32.

In the embodiment depicted in FIG. 4, base member 42 includes sections 50 interconnecting platforms 46 with central support step 44 and having holes therein for receiving bolts 52 for securing base member 42 to support structure 40.

In accordance with the invention, the upper edge of locking projection 26 is formed into an elongated bead 33 as seen in FIG. 6. As depicted in FIGS. 2, 3 and 6, U-shaped metal clip fasteners 34 are engaged on the upper edge of locking projection 26 overlapping bead 33. In the embodiment depicted in FIG. 4, the U-shaped metal clip fasteners 54 are engaged on the upper edge of locking projection 48.

In accordance with the invention, an elongated extruded metal cap member having an axial length and transverse width is provided. The cap member includes an integral, axially elongated slot for engaging the clip fasteners on the locking projection, and further includes axially elongated panel contacting areas on each side of the slot disposed to contact the upper surface of the panels.

As embodied and depicted in FIGS. 2 and 3, elongated, extruded metal cap member 36 has an axial length and transverse width; the cap member 36 includes an integral, axially elongated slot 38 for engaging clip fasteners 34 on locking projection 26. Cap member 36 further includes axially elongated panel contacting areas 43 on each side of slot 38 disposed to contact the upper surface of panels 10.

Preferably, panel contacting areas 43 on cap member 36 are co-planar and cap member 36 includes cap projection 41 extending above panel contacting areas 43, the cap projection 41 including the slot 38.

In another embodiment depicted in FIG. 4, elongated, extruded metal ridge cap member 56 has an axial length and transverse width. Ridge cap member 56 includes an integral, axially elongated slot 58 for engaging clip fasteners 54 on locking projection 48. Slot 58 is formed by a pair of depending flanges 57 integrally formed with ridge cap member 56 and flaring outwards at the distal ends thereof. Ridge cap member 56 further includes axially elongated flanges 60 extending from each side of slot 58. Depending from flange 60 are L-shaped flanges 62 providing a panel contact area on each side of slot 58 disposed to contact the upper surface of panels 10.

It is preferred in the embodiments depicted in FIGS. 2, 3 and 4 for slot 38, 58 to include an inwardly tapered entry portion and a larger clip receiving portion at its inner extremity.

It is preferred in the embodiment depicted in FIG. 4, that base member 42 have upper and lower surfaces. The upper surface is defined by elongated planar contacting areas on central step 44 and platform 46 with fastener receiving area 50 between central step 44 and platform 46. Platform 46 constitutes an outer contacting area adjacent to fastener receiving area 50. The lower surface is defined by flanges 51 depending from platforms 46 and fastener receiving areas 50. A concave portion is defined between flanges 51 and fastener receiving areas 50.

In use, the device affixes abutting panels to the roof support structure forming a roof, particularly in greenhouses and solar energy collection devices. Referring to FIG. 7, it can be seen that panels 10 extend transverse building 12 between long walls 8. Panels 10 are supported by beams forming an arch roof support structure. The beams may be tubular as in FIG. 2 or I-beams as depicted in FIG. 3.

The device for affixing the panels to the roof structure includes means along the seam between the panels 10 which extend between the long walls 8 of building 12. Device 14 is made of an extruded metal, however, it is sufficiently flexible to permit slight bending over an archroof structure so that the device securing panels 10 in their side-abutting relationship is continuous between long walls 8.

At the eaves proximate the top edges of long walls 8, means are provided extending the length of the building and secured to the beams of the roof support structure proximate the top edge of the long wall 8, for engaging the end edges of the side adjacent panels 10. The eave means is an elongated extruded metal structure 11 depicted in FIGS. 7 and 5 which includes elongated U-shaped base member 13 defining an elongated channel 15 for receiving means for securing base member 13 to beams 40. An elongated C-shaped member 17 defining elongated channels 19 for receiving the end edge of panels 10 is integrally formed at its bottom arm 21 with the top edge of one arm 23 of the U-shaped base member 13. The end edges of panels 10 are received in channels 19 leaving space for longitudinal expansion of the panels 10. The bottom arm 21 of the C-shaped edge member 17 and the top edge of the other arm of the U-shaped base member 13 define a generally planar surface.

As seen in FIG. 5, the dimensions of the eave means 11 when disposed on the roof support beams 40 are co-planar with thee respective dimensions of the device 14 for sealing the side edges of the panels 10. For example, the axially elongated panel contacting areas 36 contacting the top surface of panel 10 are substantially co-planar with the top arm of C-shaped edge member 17 and the axially elongated flange 24 forming a contact area contacting the bottom surface of panels 10 are co-planar with the bottom arm 21 of C-shaped edge member 17 and the top edge of the other arm of U-shaped member 13.

In installation, as seen in FIGS. 4 and 5, cap members 36 with cap projections 41, at one end thereof, are disposed beneath the ends of flanges 60 of ridge cap member 56 abutting L-shaped flanges 62. The other end of cap members 36 are disposed over the top arm of C-shaped edge member 17; the flexibility of cap members 36 permitting the central portions thereof to be substantially co-planar with the top arm of C-shaped edge member 17 and in substantial contact with panels 10. Preferably, cap members 36 at the opposite ends thereof are secured to flange 60 of ridge cap member 56 and to the top arm of C-shaped edge member 17, respectively by screws 59, 61. Screws 59 are screwed through the ends of flanges 60 into the top of cap projection 41. Screws 61 are screwed through cap members 36, the top arms of C-shaped edge members 17 and into panels 10. Holes in panels 10 are provided for receiving screws 61, the holes being larger than screws 61 to permit expansion and contraction of panels 10.

As seen in FIG. 1, the same system may be used to install the roof panels for a pitch-type roof where the device of the invention is disposed between adjacent upper end edges of panels 10 at the apex of the roof structure which may be seen in cross-section in FIG. 5. The upper end edges of panels 10 contact central support step 44 and the space defined between central support step 44 and the flared portions of flanges 57 depending from ridge cap member 56 receives the upper end edges of panels 10 on longitudinal expansion thereof. The dimensions of the apex affixing device 16 are co-planar with the seam sealing device 14 and the eave means 11.

What is claimed is:

1. A device for affixing two adjacent panels to a support structure, said device comprising:

(a) an elongated, extruded metal base member having an axial length and transverse width, said base member including means for engaging the under side of each of said panels, said engaging means contacting each of said panels at at least two transversely spaced, axially elongated contacting areas, said contacting areas being arranged in two groups, each of said groups of contacting areas defining a generally planar surface, said base member further including an integral, axially elongated locking projection having a height in excess of the thickness of said panels, the distal edge of said locking projection having an elongated bead, said base member further including means for affixing said base member to said support structure, said affixing means comprising means for receiving headed fasteners between said contacting areas;

(b) an elongated, substantially rigid extruded metal cap member having an axial length and transverse width, said cap member including an integral, axially elongated slot for engaging said locking projection, said cap member further including axially elongated co-planar panel contacting areas on each side of said slot disposed to contact the upper surface of said panels and adapted to retain the panels on the base members while enabling differential thermal expansion and contraction of the panel, base member and cap, said panel contacting areas overlying said axially elongated contacting areas of the base member; and (c) a plurality of U-shaped metal clip fasteners engaged and held on the bead on the distal edge of said locking projection in spaced-apart relation for securing said locking projection into said slot.

2. In a rectangular building including a pair of parallel long walls, a plurality of beams forming an arch roof support structure, and a plurality of rectangular roof panels disposed on said roof support structure and extending between said long walls, a device for affixing said panels to said roof structure comprising:

(a) seam means having a long axis normal to said long walls extending between said long walls for affixing roof panels in adjacent relationship and for affixing said panels to said roof support structure, said seam means comprising:

(1) axially elongated extruded metal base members disposed proximate the edges of adjacent panels and extending between said long walls, each said base member including means for engaging the undersurface of each of said adjacent panels, said engaging means contacting each of said adjacent panels at at least two transversely spaced axially elongated contacting areas, said contacting areas being arranged in two groups, each of said groups of contacting areas defining a generally planar surface and defining an axially elongated channel, each said base member further including an integral, axially elongated locking projection extending between the edges of said adjacent panels, said projection having height in excess of the thickness of said panels, and each of said base members further including means for affixing said base member to said beams, said affixing means comprising means for receiving headed fasteners between said contacting areas, (2) a plurality of U-shaped metal clip fasteners engaged on the edge of each said locking projection, and (3) axially elongated extruded metal cap members extending between said long walls and cooperating with said base members, each said cap member including an integral, axially elongated slot for engaging said clip fasteners on said locking projection, and each said cap member further including integral, axially elongated panel contacting areas on each side of said slot disposed to contact the upper surface of said adjacent panels; and (b) eave means extending the length of said building and secured to said beams proximate the top edge of said long walls for engaging the end edges of said adjacent panels, said eave means comprising:

(1) elongated U-shaped base members each defining an elongated channel for receiving means for securing said base members to said beams, and (2) elongated C-shaped edge members each defining an elongated channel for receiving the end edges of said panels, the bottom arm of said C-shaped edge member being integral with the top edge of one arm of said U-shaped base member and defining a generally planar surface with the top edge of the other arm of said U-shaped base member.

3. The device of claim 1 or 2 wherein both of said panel contacting areas on said cap member are co-planar and said cap member includes a cap projection extending above said panel contacting areas, said cap projection including said slot.

4. In a rectangular building including a pair of parallel long walls, a plurality of beams forming a pitch roof support structure, and a plurality of rectangular roof panels disposed on said roof structure extending between said long walls and the apex of said pitch roof support structure, a device for affixing said panels to said roof structure comprising:

(a) apex means disposed along the apex of said pitch roof support structure having a long axis parallel to said long walls and a transverse width for receiving first edges of said panels adjacent said apex and for affixing said first edges to said roof support structure at said apex, said means comprising:

(1) an axially elongated extruded metal apex base member disposed along the apex of said pitch roof support structure, said apex base member including an integral, axially elongated locking projection extending from the center of said apex base member between said first edges, said projection having a height in excess of the thickness of said panels, said apex base member further including means on each side of each projection for engaging the undersurface of said panels, each said engaging means contacting said panels at at least two transversely spaced elongated contacting areas, the two spaced contacting areas of each engaging means defining a generally planar surface substantially parallel to the apex of said roof support structure and defining a channel therebetween for receiving means for affixing said apex base member to said beams on each side of the apex of said roof structure;

(2) a plurality of U-shaped metal clip fasteners engaged on the edge of said locking projection, and (3) an axially elongated, extruded metal cap member extending along the apex of said roof support structure and cooperating with said apex base member, said cap member including an integral, axially elongated slot for engaging said clip fasteners on said locking projection, and said cap member further including axially elongated panel contacting areas on each side of said slot disposed to contact the upper surface of said panels;

(b) seam means having a long axis normal to said long walls and a transverse width extending between said apex means and said long walls for affixing second edges of said panels in adjacent relationship and for affixing said panels to said roof support structure, said seam (1) axially elongated extruded metal base members disposed proximate the second edges of adjacent panels and extending between said long wall and said apex means, each said base member including means for engaging the undersurface of said panels, said engaging means contacting each of said panels at at least two transversely spaced, axially elongated contacting areas, said contacting areas being arranged in two groups, each of said groups of contacting areas defining a generally planar sufface substantially co-planar with the planar surface defined by the respective contacting areas of the engaging means of said apex base members and further defining an elongated channel disposed transverse said building, each said base member further including an integral, axially elongated locking projection extending between the second edges of said adjacent panels, said projection having a height in excess of the thickness of said panels, and each said base member further including means for affixing said base member to said beams, said affixing means comprising means for receiving headed fasteners between said contacting areas, (2) a plurality of U-shaped metal clip fasteners engaged on the edge of each said locking projection, and (3) axially elongated extruded metal cap members extending between said long walls and said apex means and cooperating with said base member, each said cap member including an integral, axially elongated slot for engaging said clip fasteners on said locking projection, and each said cap member further including integral, axially elongated panel contacting areas on each side of said slot disposed to contact the upper surfaces of said adjacent panels; and (c) eave means extending the length of said building and secured to said beams proximate the top edge of said long walls for engaging third edges of said panels adjacent said long walls, said eave means comprising:

(1) elongated U-shaped base members each defining an elongated channel for receiving means for securing said base member to said beams, and (2) elongated C-shaped edge members each defining an elongated channel for receiving the third edges of said panels, the bottom arm of said C-shaped edge member being integral with the top edge of one arm of said U-shaped base member and defining a generally planar surface with the top edge of the other arm of said U-shaped base member, said planar surface being substantially co-planar with the planar surface defined by the two contacting areas of respective engaging means of said apex base member.

* * * * *

UNITED STATES PATENT AND TRADEMARK OFFICE

CERTIFICATE OF CORRECTION

PATENT NO. : 4,439,969

DATED : April 3, 1984

INVENTOR(S) : Gary F. Bartlett

It is certified that error appears in the above—identified patent and that said Letters Patent is hereby corrected as shown below:

Column 8, line 33, after "seam" insert --means comprising:--

Column 8, line 44, change "sufface" to --surface--.

Signed and Sealed this

*Eighteenth* Day of *December 1984*

[SEAL]

*Attest:*

*Attesting Officer*

GERALD J. MOSSINGHOFF

*Commissioner of Patents and Trademarks*